US010079031B2

(12) United States Patent
Yoo et al.

(10) Patent No.: US 10,079,031 B2
(45) Date of Patent: Sep. 18, 2018

(54) RESIDUAL NOISE SUPPRESSION

(71) Applicant: Marvell World Trade Ltd., St. Michael (BB)

(72) Inventors: Sungyub Daniel Yoo, San Jose, CA (US); Jin Xie, Longmont, CO (US); Kapil Jain, Santa Clara, CA (US)

(73) Assignee: Marvell World Trade LTD., St. Michael (BB)

( * ) Notice: Subject to any disclaimer, the term of this patent is extended or adjusted under 35 U.S.C. 154(b) by 57 days.

(21) Appl. No.: 15/252,091

(22) Filed: Aug. 30, 2016

(65) Prior Publication Data

US 2017/0084289 A1 Mar. 23, 2017

Related U.S. Application Data

(60) Provisional application No. 62/222,541, filed on Sep. 23, 2015.

(51) Int. Cl.

| | |
|---|---|
| ***G10L 25/78*** | (2013.01) |
| ***G10L 21/0208*** | (2013.01) |
| ***G10L 21/034*** | (2013.01) |
| ***G10L 25/84*** | (2013.01) |

(52) U.S. Cl.

CPC ..... *G10L 25/84* (2013.01); *G10L 21/0208* (2013.01); *G10L 21/034* (2013.01); *G10L 2025/783* (2013.01)

(58) Field of Classification Search

None

See application file for complete search history.

(56) References Cited

U.S. PATENT DOCUMENTS

| | | | | |
|---|---|---|---|---|
| 9,276,618 | B1 | 3/2016 | Xie et al. | |
| 2005/0228647 | A1* | 10/2005 | Fisher | G10L 25/78 704/205 |
| 2009/0190774 | A1* | 7/2009 | Wang | G10L 21/028 381/92 |
| 2012/0059650 | A1* | 3/2012 | Faure | G10L 25/69 704/226 |
| 2012/0300958 | A1* | 11/2012 | Klemmensen | H04R 25/43 381/81 |
| 2014/0270219 | A1* | 9/2014 | Yu | H04R 3/005 381/71.1 |
| 2015/0058003 | A1* | 2/2015 | Mohideen | G10L 15/20 704/233 |

* cited by examiner

*Primary Examiner* — Richa Mishra

(57) ABSTRACT

A method includes determining a preprocessed audio signal by removing some noise from an input audio signal. Here, portions of the preprocessed audio signal that include speech are separated by portions of the preprocessed audio signal that include residual noise. Additionally, the method includes determining an amplified signal by suppressing the preprocessed audio signal over the portions that include residual noise, and maintaining the preprocessed audio signal over the portions that include speech.

16 Claims, 14 Drawing Sheets

*Key:*
101 – $S_{RN}$ or signal w/ residual noise;
123 – E or envelope of $S_{RN}$;
125 – $E_S$ or slow envelope;
127 – $Th_1$ or first threshold;
129 – $Th_2$ or second threshold;
157 – G or suppression gain.

801A'

Example of ambient noise inside car on road trip

Time ($1/f_S$)

101'

Time ($1/f_S$)

111'

Time ($1/f_S$)

801A"

Example of ambient noise on street

Time ($1/f_S$)

101"

Time ($1/f_S$)

111"

Time ($1/f_S$)

RESIDUAL NOISE SUPPRESSION

CROSS-REFERENCE TO RELATED APPLICATIONS

This disclosure claims priority to U.S. Provisional Application Ser. No. 62/222,541, filed Sep. 23, 2015, the disclosure of which is incorporated herein by reference in its entirety.

BACKGROUND

The present disclosure is generally related to technologies used for suppressing residual noise from preprocessed audio signals. More specifically, for a preprocessed audio signal that includes portions of speech, the disclosed technologies are used for suppressing residual noise from portions of the preprocessed audio signal between the portions of speech without distorting the speech portions.

A microphone of an audio receiver, e.g., of a mobile device, can receive (i) a speech signal (or simply speech) that arrives at the audio receiver along a "speech direction", from where a user of the mobile device is expected to speak, and (ii) ambient noise along other directions, (in large part) different from the speech direction. Typically, the speech includes utterances separated by silence. As such, the microphone provides to the audio receiver an audio signal that includes portions of noisy speech (corresponding to a combination of the utterances and ambient noise) separated by portions of ambient noise (corresponding only to the ambient noise that "fills" the silence between the utterances). The audio receiver can use conventional technologies for suppressing the ambient noise from the audio signal without distorting the speech, thus forming a "speech beam" that appears to have been received at the audio receiver along the speech direction. The speech beam, referred here as a preprocessed audio signal, includes portions of speech (corresponding to a combination of the utterances and suppressed ambient noise) separated by portions of residual noise (corresponding only to the suppressed ambient noise). Although the speech included in the input audio signal can be reproduced in the portions of speech of the preprocessed audio signal with minor distortion, such that the speech distortion is hardly noticeable when a user listens to the preprocessed audio signal, the portions of residual noise of the preprocessed audio signal may sound too loud for the user.

SUMMARY

In this disclosure, technologies are described that can be used, for a preprocessed audio signal that includes portions of speech separated by portions of residual noise, to suppress the preprocessed audio signal over the portions of residual noise without distorting the portions of speech.

One aspect of the disclosure can be implemented as a method that includes determining a preprocessed audio signal by removing some noise from an input audio signal. Here, portions of the preprocessed audio signal that include speech are separated by portions of the preprocessed audio signal that include residual noise. Additionally, the method includes determining an amplified signal by suppressing the preprocessed audio signal over the portions that include residual noise, and maintaining the preprocessed audio signal over the portions that include speech.

Implementations can include one or more of the following features. In some implementations, the method can include determining the portions of the preprocessed audio signal that include residual noise as corresponding to times when an envelope of the preprocessed audio signal is less than or equal to a first threshold signal; and determining the portions of the preprocessed signal that include speech as corresponding to times when the envelope of the preprocessed audio signal is larger than the first threshold signal.

In some cases, a value of the first threshold signal can be in a range from 5% to 20% of a maximum value of the envelope of the preprocessed audio signal. In some cases, the method can include setting a gain signal for controlling gain of an amplifier used on the preprocessed audio signal to (i) a value equal to a maximum gain value for the portions of the preprocessed audio signal that include speech, and (ii) at least one value smaller than the maximum gain value and larger than or equal to a threshold ratio for the portions of the preprocessed audio signal that include residual noise. For example, a value of the threshold ratio can be from 1% to 5% of a maximum value of the maximum gain value.

In some cases, the method can include determining a filtered signal using a nonlinear filter on the preprocessed audio signal; and determining the first threshold signal as the filtered signal biased by a bias factor, and a second threshold signal as the first threshold signal biased by a threshold ratio. Values of the gain signal for the portions of the preprocessed audio signal that include residual noise can include (i) a ratio of the envelope of the preprocessed audio signal to the first threshold signal, when the envelope of the preprocessed audio signal is larger than or equal to the second threshold signal, and (ii) a ratio of the second threshold signal to the first threshold signal, when the envelope of the preprocessed audio signal is smaller than the second threshold signal. For example, the bias factor can be in a range from 5% to 20% of a maximum value of the envelope of the preprocessed audio signal. Also, the determining of the filtered signal using the nonlinear filter on the preprocessed audio signal can include using a low pass filter having a cutoff frequency on a magnitude of the preprocessed audio signal; limiting an increase of the filtered signal to a positive value of an envelope limit when the filtered signal increases by more than the positive value of the envelope limit; and limiting a decrease of the filtered signal to a negative value of the envelope limit when the filtered signal decreases by more than the negative value of the envelope limit.

In some cases, the method can include determining the envelope of the preprocessed audio signal by (i) using a low pass filter having a cutoff frequency on a magnitude of the preprocessed audio signal when the envelope of the preprocessed audio signal increases, and (ii) scaling the envelope of the preprocessed audio signal by a release time when the envelope of the preprocessed audio signal decreases.

In some implementations, the input audio signal can include speech and ambient noise. In such case, the method can include obtaining (i) the portions of the preprocessed audio signal that include speech based on the removing of some noise from portions of the input audio signal that include both the speech and the ambient noise, and (ii) the portions of the preprocessed audio signal that include residual noise based on the removing of some noise from portions of the input audio signal that include only the ambient noise.

Another aspect of the disclosure can be implemented as a signal processing system that includes an amplifier to determine an amplified signal from a preprocessed audio signal and based on a gain signal. The preprocessed audio signal includes portions of speech separated by portions of residual noise. Additionally, the signal processing system includes a gain suppressor to (i) determine the portions of residual noise of the preprocessed audio signal as corresponding to times when an envelope of the preprocessed audio signal is at most equal to a first threshold signal; (ii) determine the portions of speech of the preprocessed audio signal as corresponding to times when the envelope of the preprocessed audio signal is larger than the first threshold signal; and (iii) set the gain signal to (1) a value equal to a maximum gain value for the portions of speech of the preprocessed audio signal, and (2) at least one value smaller than the maximum gain value and larger than or equal to a threshold ratio for the portions of residual noise of the preprocessed audio signal.

Implementations can include one or more of the following features. In some implementations, a value of the first threshold signal can be in a range from 5% to 20% of a maximum value of the envelope of the preprocessed audio signal. In some implementations, a value of the threshold ratio can be in a range from 1% to 5% of a maximum value of the maximum gain value.

In some implementations, the signal processing system can include a nonlinear filter to determine a filtered signal from the preprocessed audio signal; and a threshold generator to generate (i) the first threshold signal as the filtered signal weighted by a bias factor, and (ii) a second threshold signal as the first threshold signal weighted by the threshold ratio. Here, the at least one value of the gain signal for the portions of residual noise of the preprocessed audio signal can include (1) a ratio of the envelope of the preprocessed audio signal to the first threshold signal, when the envelope of the preprocessed audio signal is larger than or equal to the second threshold signal, and (2) a ratio of the second threshold signal to the first threshold signal, when the envelope of the preprocessed audio signal is smaller than the second threshold signal. In some cases, the bias factor can be in a range from 5% to 20% of a maximum value of the envelope of the preprocessed audio signal. In some cases, wherein, to determine the filtered signal, the nonlinear filter can low pass filter, based on a first cutoff frequency, a magnitude of the preprocessed audio signal; and limit an increase of the filtered signal to a positive value of an envelope limit, when the filtered signal increases by more than the positive value of the envelope limit, and limit a decrease of the filtered signal to a negative value of the envelope limit, when the filtered signal decreases by more than the negative value of the envelope limit.

In some implementations, the signal processing system can include an envelope generator to low pass filter, based on a cutoff frequency, the magnitude of the preprocessed audio signal when the envelope increases; and scale the envelope by a release time when the envelope decreases.

In some implementations, the signal processing system can include a hardware processor; and storage medium encoded with instructions that, when executed by the hardware processor, cause the signal processing system to use the gain suppressor. In some implementations, the signal processing system can be a system on chip.

In some implementations, the signal processing system can include a beam-former to receive an input audio signal, wherein the input audio signal includes speech and ambient noise; and obtain the speech portions of the preprocessed audio signal by removing some noise from portions of the input audio signal that include both the speech and the ambient noise, and obtain the residual noise portions of the preprocessed audio signal by removing some noise from portions of the input audio signal that include only the ambient noise.

The disclosed technologies can result in one or more of the following potential advantages. For example, an audio signal that includes speech received from a speech direction and ambient noise received from other directions can be processed. A first signal processing stage obtains a preprocessed audio signal that includes residual noise representing a suppressed version of the ambient noise. The disclosed technologies can be used to obtain a processed audio signal in which the residual noise included in the preprocessed audio signal has been suppressed, and the speech included in the preprocessed audio signal has been maintained with minor distortion. As such, the speech distortion is hardly noticeable when a user listens to the processed audio signal.

Details of one or more implementations of the disclosed technologies are set forth in the accompanying drawings and the description below. Other features, aspects, descriptions and potential advantages will become apparent from the description, the drawings and the claims.

Certain illustrative aspects of the systems, apparatuses, and methods according to the disclosed technologies are described herein in connection with the following description and the accompanying figures. These aspects are, however, indicative of but a few of the various ways in which the principles of the disclosed technologies may be employed and the disclosed technologies are intended to include all such aspects and their equivalents. Other advantages and novel features of the disclosed technologies may become apparent from the following detailed description when considered in conjunction with the figures.

DETAILED DESCRIPTION

Figure 1A:
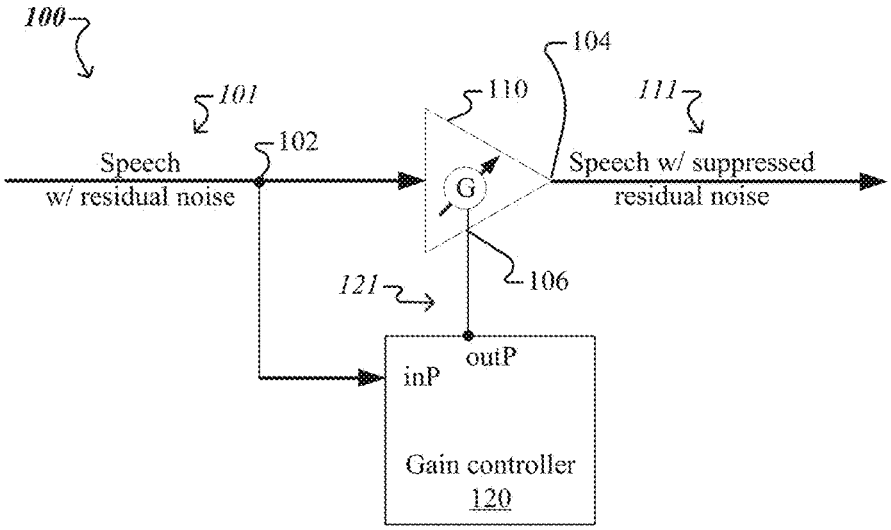
FIG. 1A shows an example of a signal processing system.

FIG. 1A shows an example of a signal processing system 100 that includes an amplifier 110 and a gain controller 120. The amplifier 110 has controllable gain and includes an input port 102, an output port 104 and a gain control port 106. The gain controller 120 includes an input port (inP) and an output port (outP). The input port of the gain controller 120 is linked to the input port 102 of the amplifier 110, and the output port of the gain controller is linked to the gain control port 106 of the amplifier.

Figure 1B:
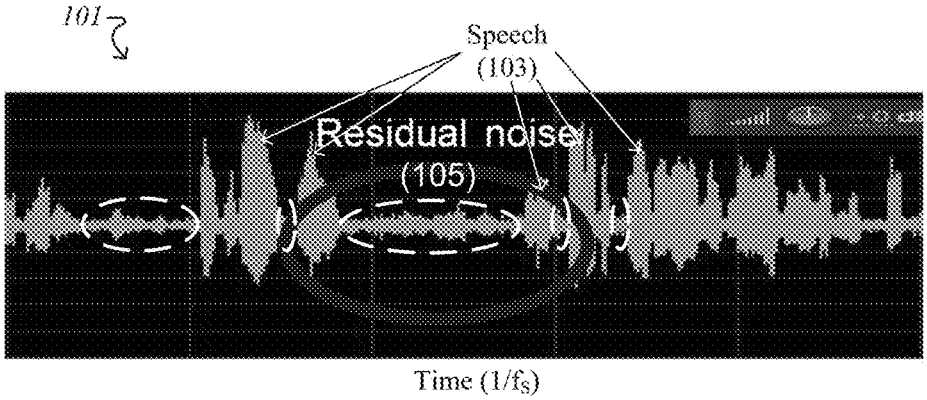
FIGS. 1B-1C show aspects of signals input to, and output from, the signal processing system of FIG. 1A.

A preprocessed audio signal 101 received at the input port 102 includes portions of speech and portions of residual noise. FIG. 1B shows an example of a preprocessed audio signal 101 that includes portions of speech 103 (e.g., bursts of signal having large rms variation that are indicated by arrows) and portions of residual noise 105 (e.g., portions of signal having small rms variation that are inscribed by ellipses). The signal processing system 100 is configured to suppress the preprocessed audio signal 101 over the portions of residual noise 105, and maintain, undistorted, the preprocessed audio signal over the portions of speech 103. As such, the signal processing system illustrated in FIG. 1A also is referred to as a residual noise suppressor 100.

Figure 1C:
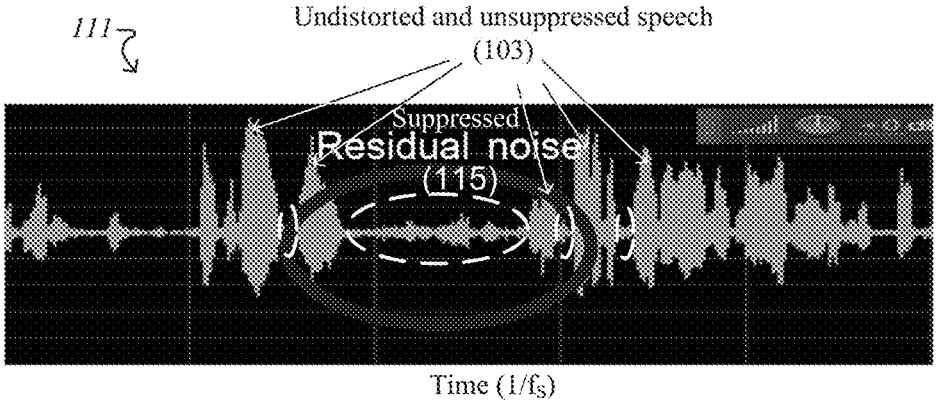

The gain controller 120 accesses the preprocessed audio signal 101 and generates a gain signal 121 based on information determined from the preprocessed audio signal, as described below in connection with FIG. 2. The amplifier 110 amplifies the preprocessed audio signal 101, while the amplifier's gain is being controlled by the gain controller 120 based on the gain signal 121. In this manner, the amplifier 110 outputs a processed audio signal 111 that includes portions of speech (corresponding to undistorted and unsuppressed portions of speech 103 of the preprocessed audio signal 101) and portions of suppressed residual noise (corresponding to suppressed portions of residual noise 105 of the preprocessed audio signal.) An example of such processed audio signal 111 is shown in FIG. 1C. The processed audio signal 111 includes portions of speech 103 (e.g., the same portions of speech 103 of the preprocessed audio signal 101 shown in FIG. 1B) and portions of suppressed residual noise 115 (e.g., portions of signal that are inscribed by ellipses and have an rms variation that is 6 dB smaller than the rms variation of the portions of residual noise 105 of the preprocessed audio signal shown in FIG. 1B).

Figure 2:
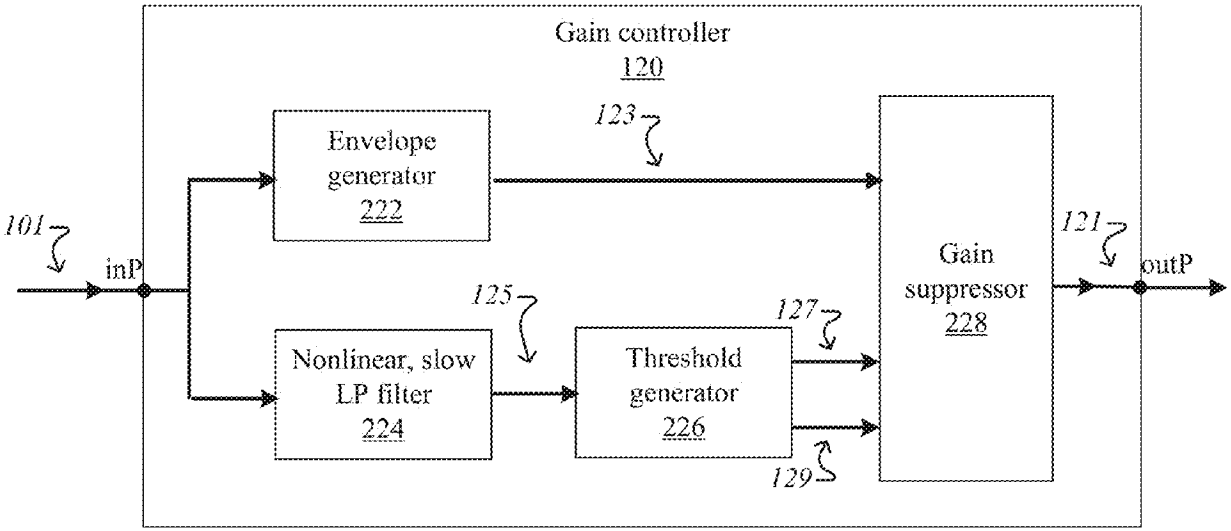
FIG. 2 shows an example of a gain controller.

FIG. 2 shows an implementation of the gain controller 120. The gain controller 120 has an input port (inP) through which it accesses the preprocessed audio signal 101 (shown in FIG. 1B) and an output port (outP) to issue the gain signal 121. The gain controller 120 includes an envelope generator 222 and a nonlinear filter 224, each of which is linked to the input port (inP). The gain controller 120 further includes a gain suppressor 228 linked to both the output port (outP) and the envelope generator 222. Also, the gain controller 120 includes a threshold generator 226 linked to both the nonlinear filter 224 and the gain suppressor 228.

The envelope generator 222 determines (as described below in connection with FIG. 3A) an envelope 123 of the preprocessed audio signal 101. The nonlinear filter 224 filters (as described below in connection with FIG. 4) the preprocessed audio signal 101 to obtain a filtered signal 125. The threshold generator 226 uses (as described below in connection with FIG. 5) the filtered signal 125 to generate a first threshold signal 127 and a second threshold signal 129. The gain suppressor 228 uses the envelope 123 and at least one of the first threshold signal 127 and the second threshold signal 129 to (i) identify portions of residual noise 105 of the preprocessed audio signal 101, and (ii) generate the gain signal 121 that, for the portions of residual noise of the preprocessed audio signal, has values that are smaller than values of the gain signal for the speech portions of the preprocessed audio signal. In this manner, the gain signal 121 can be used to control the gain of the amplifier 110 to suppress the preprocessed audio signal 101 over its portions of residual noise 105 and leave the preprocessed audio signal unsuppressed and undistorted over its portions of speech 103.

Figure 3A:
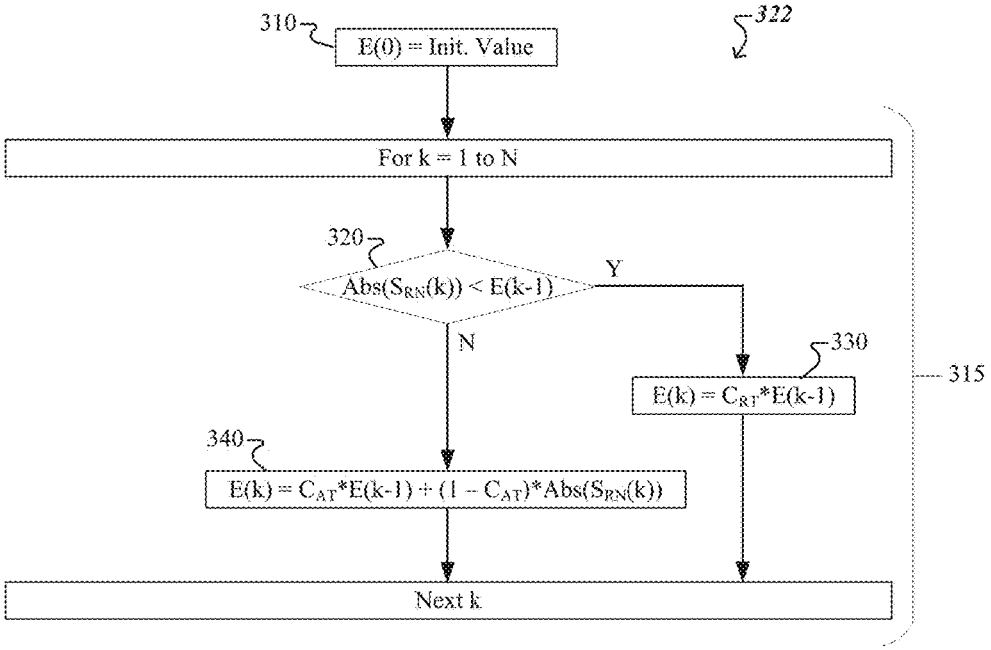
FIG. 3A is a flow chart of an example of a process performed by an envelope generator.
Figure 3B:
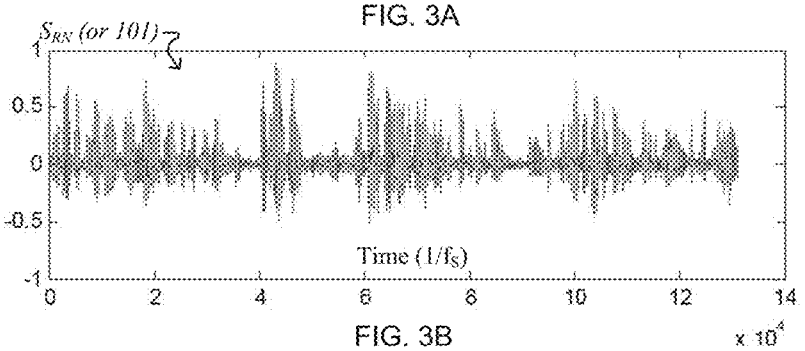
FIGS. 3B-3C show aspects of signals input to, and output from, the envelope generator of FIG. 3A.

FIG. 3A is a flow chart of an example of a process 322 performed by the envelope generator 222 to determine the envelope 123 of the preprocessed audio signal 101. In the flow chart of FIG. 3A, the preprocessed audio signal 101 is denoted by the symbol $S_{RN}$. As such, $S_{RN}(k)$ corresponds with the $k^{th}$ sample of the preprocessed audio signal $S_{RN}$, where k=0 . . . N. The total number of samples (N+1) may be determined based on the total sampling time $T_S$ and sampling frequency $f_S$, where, for example, $(N+1)=T_S f_S$. FIG. 3B shows an example of a preprocessed audio signal $S_{RN}$ (also labeled 101) determined over a sampling time $T_S$=17 sec using a sampling frequency $f_S$=8 kHz, such that the total number of samples of the preprocessed audio signal $S_{RN}$ is 13.6e4 samples.

Additionally in the flow chart of FIG. 3A, the envelope 123 of the preprocessed audio signal $S_{RN}$ is denoted by the symbol E. As such, E(k) corresponds with the $k^{th}$ sample of the envelope E, where k=0 . . . N. To minimize distortions of the speech portions 103 and maximize suppression of the residual noise portions 105 of the preprocessed audio signal $S_{RN}$, the envelope E of the preprocessed audio signal is determined based on an attack time constant $C_{AT}$ and a release time constant $C_{RT}$ as described below.

At 310, the zeroth sample of the envelope E, i.e., E(0), is initialized to an initial value. For example, the initial value of E(0) can be initialized to zero. As another example, the initial value of E(0) can be set to the magnitude of the zeroth sample of the preprocessed audio signal $S_{RN}$(0), i.e., E(0) =abs($S_{RN}$(0)).

Loop 315 is used to determine the remaining samples of the envelope E. Each iteration is used to determine a sample of the envelope E(k) in the following manner.

At 320, it is determined whether a magnitude of the $k^{th}$ sample of the preprocessed audio signal $S_{RN}(k)$ is smaller than the priori $(k-1)^{th}$ sample of the envelope E(k−1), $abs(S_{RN}(k))<E(k-1)$. If a result of the determination performed at 320 is true, then it is inferred that the envelope E of the preprocessed audio signal $S_{RN}$ is decreasing. As such, at 330, the envelope E of the preprocessed audio signal $S_{RN}$ is scaled by a release time constant $C_{RT}$. For example, the $k^{th}$ sample of the envelope E(k) is determined as:

$$E(k)=C_{RT}E(k-1) \quad (1).$$

At this point, a next iteration of the loop 315 is triggered to determine the next sample of the envelope E(k+1), and so on.

However, if a result of the determination performed at 320 is false, then it is inferred that the envelope E of the preprocessed audio signal $S_{RN}$ is increasing. As such, at 340, the envelope E of the preprocessed audio signal $S_{RN}$ is filtered using a first low pass filter having a first cutoff frequency $f_{C1}$ that depends on the value of an attack time constant $C_{AT}$, where the attack time constant $C_{AT}$ satisfies the inequality, $0 \le C_{AT} \le 1$. In this manner, the $k^{th}$ sample of the envelope E(k) is determined as a weighted sum of the magnitude of the $k^{th}$ sample of the audio signal $N_R(k)$ and a previous sample of the envelope E(k−1) in the following manner:

$$E(k)=C_{AT}E(k-1)+(1-C_{AT})abs(S_{RN}(k)) \quad (2).$$

A small value of the attack time constant $C_{AT}$ corresponds to a small value of the first cutoff frequency $f_{C1}$ associated with a slow first low pass filter; and a large value of the attack time constant $C_{AT}$ corresponds to a large value of the first cutoff frequency $f_{C1}$ associated with a fast first low pass filter.

Figure 3C:
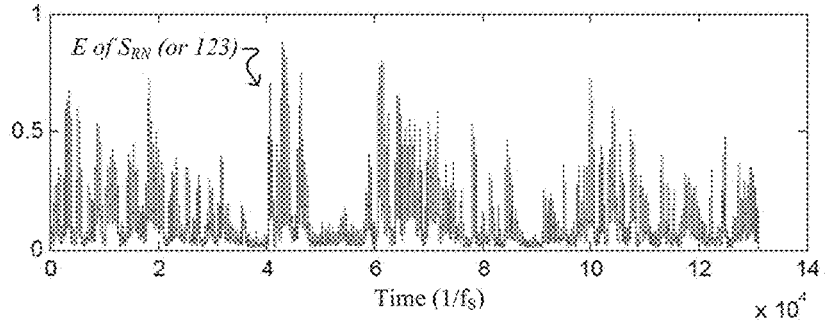

At this point, a next iteration of the loop 315 is triggered to determine the next sample of the envelope E(k+1), and so on. FIG. 3C shows the envelope E (also labeled 123) determined by using the process 322 to the preprocessed audio signal $S_{RN}$ shown in FIG. 3B. In this example, the envelope 123 (shown in FIG. 3C) follows relatively well the preprocessed audio signal 101 (shown in FIG. 3B) to which it is associated, suggesting that the first low pass filter corresponding to Eq. No. (2) is a fast filter.

Figure 4:
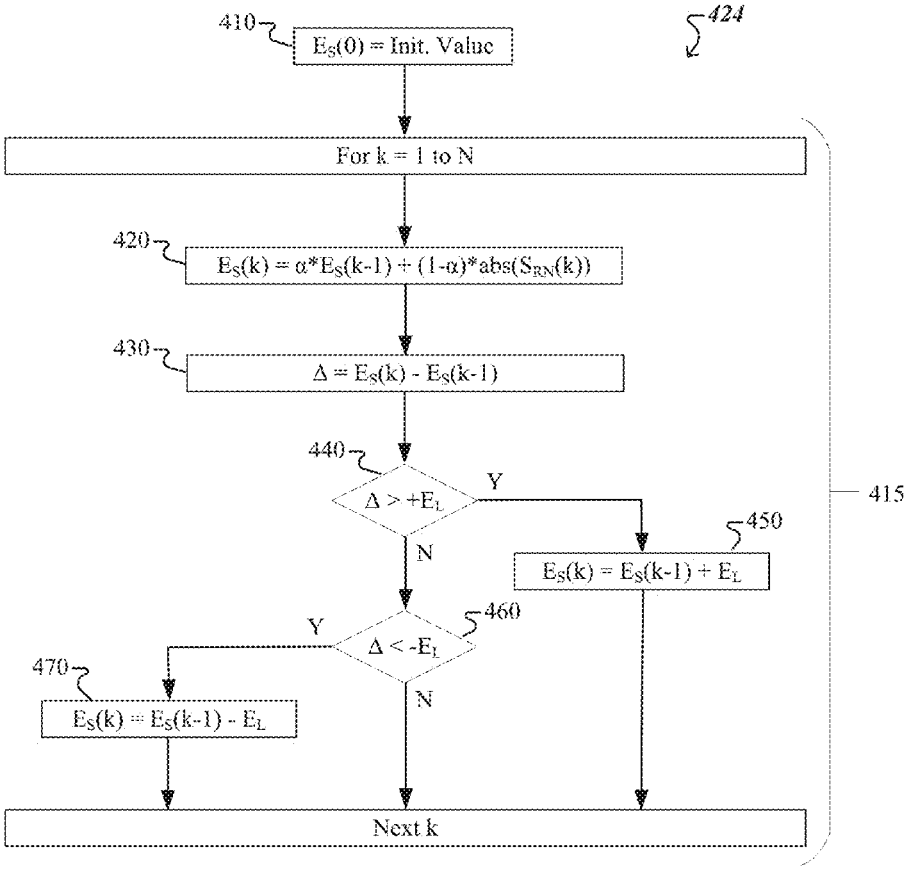
FIG. 4 is a flow chart of an example of a process performed by a nonlinear filter.

FIG. 4 is a flow chart of an example of a process 424 performed by the nonlinear filter 224 to filter the preprocessed audio signal 101 to obtain a filtered signal 125. In the flow chart of FIG. 4, the filtered signal 125 is denoted by the symbol $E_S$ and the preprocessed audio signal 101 is denoted by the symbol $S_{RN}$. As such, $E_S(k)$ and $S_{RN}(k)$ correspond with the $k^{th}$ sample of the filtered signal $E_S$, and the preprocessed audio signal $S_{RN}$, respectively, where k=0 . . . N.

At 410, the zeroth sample of the filtered signal $E_S(\mathbf{0})$ is initialized to an initial value. For example, the initial value of $E_S(\mathbf{0})$ can be initialized to zero. As another example, the initial value of $E_S(\mathbf{0})$ can be set to the magnitude of the zeroth sample of the preprocessed audio signal $S_{RN}(\mathbf{0})$, i.e., $E_S(\mathbf{0})=abs(S_{RN}(\mathbf{0}))$.

Loop 415 is used to determine the remaining samples of the filtered signal $E_S$. Each iteration is used to determine a sample of the filtered signal $E_S(k)$ in the following manner.

At 420, a $k^{th}$ sample of the filtered signal $E_S(k)$ is determined as a weighted sum of the magnitude of the $k^{th}$ sample of the preprocessed audio signal $S_{RN}(k)$ and a previous sample of the filtered signal $E_S(k-1)$. For example, the $k^{th}$ sample of the filtered signal $E_S(k)$ is determined in the following manner:

$$E_S(k)=\alpha E_S(k-1)+(1-\alpha)abs(S_{RN}(k)) \quad (3),$$

where $\alpha$ is a weight, $0\leq\alpha\leq1$.

At 430, a change $\Delta E_S$ in the filtered signal is determined, e.g., based on:

$$\Delta E_S=E_S(k)-E_S(k-1) \quad (4).$$

At 440, it is determined whether the filtered signal increases by more than a positive value of an envelope limit, $\Delta E_S>+E_L$, where a magnitude of the envelope limit is $E_L$. If a result of the determination performed at 440 is true, then, at 450, the change $\Delta E_S$ in the filtered signal is limited to the positive value of the envelope limit, such that the $k^{th}$ sample of the filtered signal $E_S(k)$ is determined as:

$$E_S(k)=E_S(k-1)+E_L \quad (5).$$

At this point, a next iteration of the loop 415 is triggered to determine the next sample of the filtered signal $E_S(k+1)$, and so on.

However, if a result of the determination performed at 440 is false, then, at 460, it is determined whether the filtered signal decreases by more than a negative value of the envelope limit, $\Delta E_S<-E_L$. If a result of the determination performed at 460 is true, then, at 470, the change $\Delta E_S$ in the filtered signal is limited to the negative value of the envelope limit, such that the $k^{th}$ sample of the filtered signal $E_S(k)$ is determined as:

$$E_S(k)=E_S(k-1)-E_L \quad (6).$$

At this point, a next iteration of the loop 415 is triggered to determine the next sample of the second filtered signal $E_S(k+1)$, and so on. Moreover, if a result of the determination performed at 460 is false, then a next iteration of the loop 415 is still triggered to determine the next sample of the filtered signal $E_S(k+1)$, and so on.

When both results of the determination performed at 440 and the determination performed at 460 are false, a magnitude of the change $\Delta E_S$ in the filtered signal is smaller than a magnitude of the envelope limit, i.e., $abs(\Delta E_S)\leq E_L$. Only when the foregoing inequality is satisfied, a value of the $k^{th}$ sample of the filtered signal $E_S(k)$ remains as determined at 420, in accordance with Eq. No. (3). As discussed above in connection with FIG. 3A, performing 420 in accordance with Eq. No. (3) corresponds to filtering the magnitude of the preprocessed audio signal $S_{RN}$ using a second low pass filter with a second cutoff frequency $f_{C2}$, where a value of the second cutoff frequency $f_{C2}$ depends on the value of the weight $\alpha$. Moreover, a value of the weight $\alpha$ of the second low pass filter used by the nonlinear filter 224 when the condition $abs(\Delta E_S)\leq E_L$ is satisfied, is chosen to be smaller than or at most equal to a value of the attack time constant $C_{AT}$ of the first low pass filter used by the envelope generator 222, such that the second low pass filter is slower than or at most as fast as the first low pass filter.

The flow chart of the process 424 can be summarized using the following portion of pseudo-code:

$$\Delta E_S=\alpha E_S(k-1)+(1-\alpha)abs(S_{RN}(k))-E_S(k-1);$$

$$\text{If } \Delta E_S>+E_L, \text{ then } \Delta E_S=+E_L;$$

$$\text{If } \Delta E_S<-E_L, \text{ then } \Delta E_S=-E_L;$$

$$E_S(k)=E_S(k-1)+\Delta E_S.$$

Figure 5:
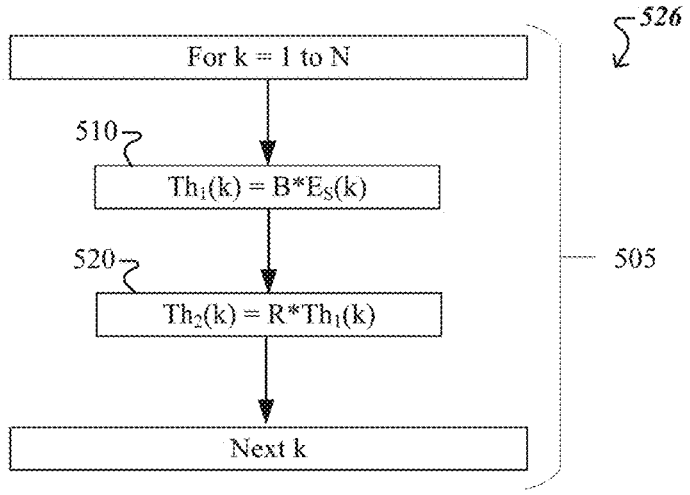
FIG. 5 is a flow chart of an example of a process performed by a threshold generator.

FIG. 5 is a flow chart of an example of a process 526 performed by the threshold generator 226 to generate, based on the filtered signal 125, a first threshold signal 127 and a second threshold signal 129. In the flow chart of FIG. 5, the first threshold signal 127 is denoted by the symbol $Th_1$, the second threshold signal 129 is denoted by the symbol $Th_2$, and the filtered signal 125 is denoted by the symbol $E_S$. As such, $Th_1(k)$, $Th_2(k)$ and $E_S(k)$ correspond with the $k^{th}$ sample of the first threshold signal $Th_1$, the second threshold signal $Th_2$, and the filtered signal $E_S$, respectively, where k=0 . . . N. Loop 505 is used to determine the samples of the first threshold signal $Th_1$ and the second threshold signal $Th_2$. Each iteration is used to determine a sample of the first threshold signal $Th_1(k)$ and a sample of the second threshold signal $Th_2(k)$ in the following manner.

At 510, the filtered signal $E_S$ is biased using a bias factor B, such that the $k^{th}$ sample of the first threshold $Th_1(k)$ is determined as:

$$Th_1(k)=BE_S(k) \quad (7).$$

The first threshold signal $Th_1$ will be used by the gain suppressor 228 to determine a level of the envelope E of the preprocessed audio signal $S_{RN}$ to be suppressed. In other words, the first threshold signal will be used to differentiate between the portions of residual noise 105 and the portions of speech 103 of the preprocessed audio signal $S_{RN}$. As such, the bias factor B can be used as a tuning parameter in accordance with Eq. No. (7) to determine the level of the envelope E of the preprocessed audio signal $S_{RN}$ to be suppressed, as described below in connection with FIG. 6A. For instance, the bias factor B can be in a range from 5% to 20% of a maximum value of the envelope E of the preprocessed audio signal $S_{RN}$.

In some implementations, the first threshold signal can be set to a single constant value, e.g., $Th_1(k)=Th_1$, for all k=1 . . . N. In this case, the constant value $Th_1$ can be the bias factor B, for instance.

At 520, the first threshold signal $Th_1$ is biased using a threshold ratio R, such that the $k^{th}$ sample of the second threshold $Th_2(k)$ is determined as:

$$Th_2(k)=RTh_1(k) \quad (8).$$

The second threshold signal $Th_2$ will be used by the gain suppressor 228 to determine an amount of the envelope E of the preprocessed audio signal $S_{RN}$ to be suppressed. In other words, the second threshold signal will be used to prevent complete suppression of the preprocessed audio signal $S_{RN}$ over its portions of residual noise 105, such that the processed audio signal 111 output by the amplifier 110 does not include portions of complete silence between the portions of speech 103. As such, the threshold ratio R can be used as a tuning parameter in accordance with Eq. No. (8) to determine the amount of the envelope E of the preprocessed audio signal $S_{RN}$ to be suppressed. For instance, the threshold ratio R can be in a range from 0.1 to 0.9.

In some implementations, the tuning of the bias factor B, or the threshold ratio R, or both, is carried out at design time, before fabrication of the gain controller 120. In some implementations, the tuning of the bias factor B, or the threshold ratio R, or both, is carried out at fabrication time, before shipping the gain controller 120 (e.g., either by itself or as part of the residual noise suppressor 100). In some implementations, the tuning of the bias factor B, or the threshold ratio R, or both, is carried out at run time (i.e., in the field), either by a user through a user interface of the gain controller 120, or by another process that interacts with the gain controller through an application programming interface (API).

Figure 6A:
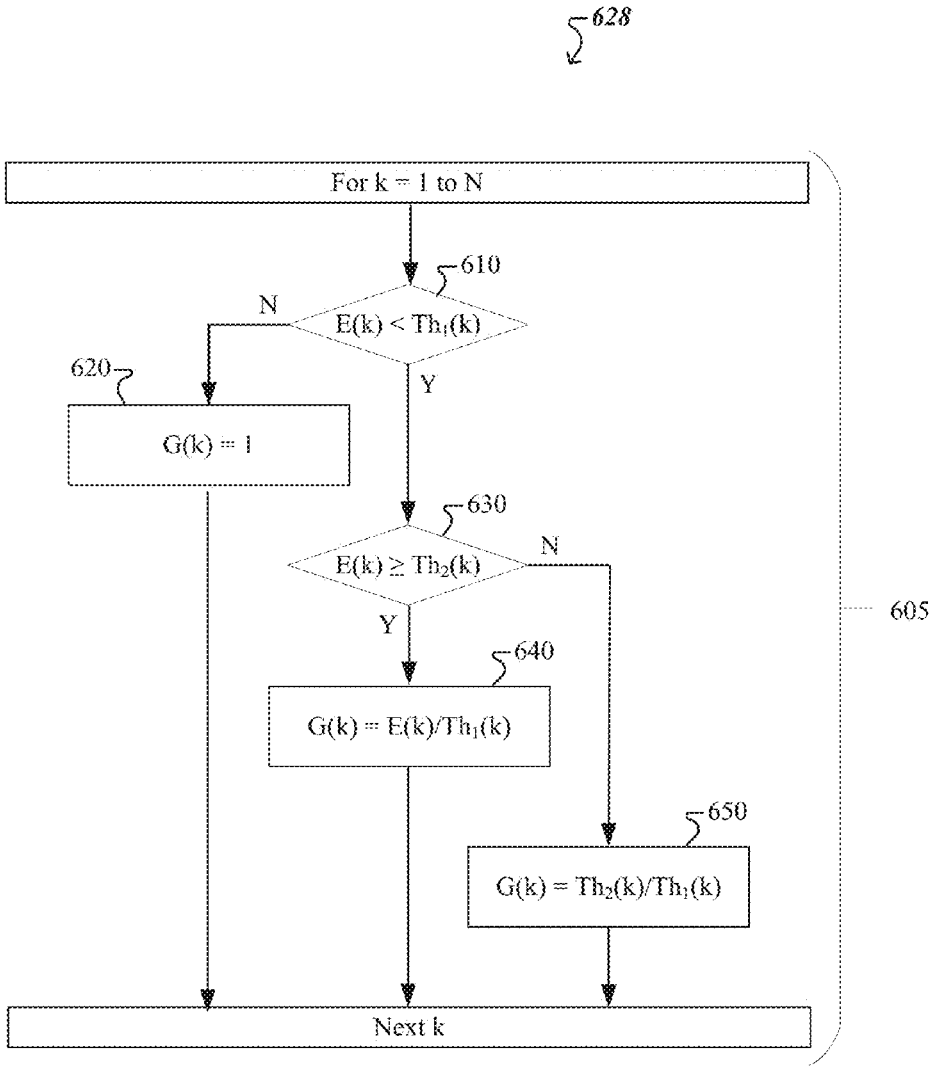
FIG. 6A is a flowchart of an example of a process performed by a gain suppressor.

FIG. 6A is a flow chart of an example of a process 628 performed by the gain suppressor 228 to (i) identify portions of speech 103 and portions of residual noise 105 of the preprocessed audio signal 101, and (ii) generate the gain signal 121 that, for the portions of residual noise of the preprocessed audio signal, has values that are smaller than values of the gain signal for the portions of speech of the preprocessed audio signal. In the flow chart of the process 628, the gain signal 121 is denoted by the symbol G, the envelope 123 of the preprocessed audio signal 101 is denoted by the symbol E, the first threshold signal 127 is denoted by the symbol $Th_1$, and the second threshold signal 129 is denoted by the symbol $Th_2$. As such, G(k), E(k), $Th_1(k)$ and $Th_2(k)$ correspond with the $k^{th}$ sample of the gain signal G, the envelope E, the first threshold signal $Th_1$ and the second threshold signal $Th_2$, respectively, where k=0 . . . N. Loop 605 is used to determine at least the samples of the gain signal G. Each iteration is used to determine at least a sample of the gain signal G(k) in the following manner.

Figure 6B:
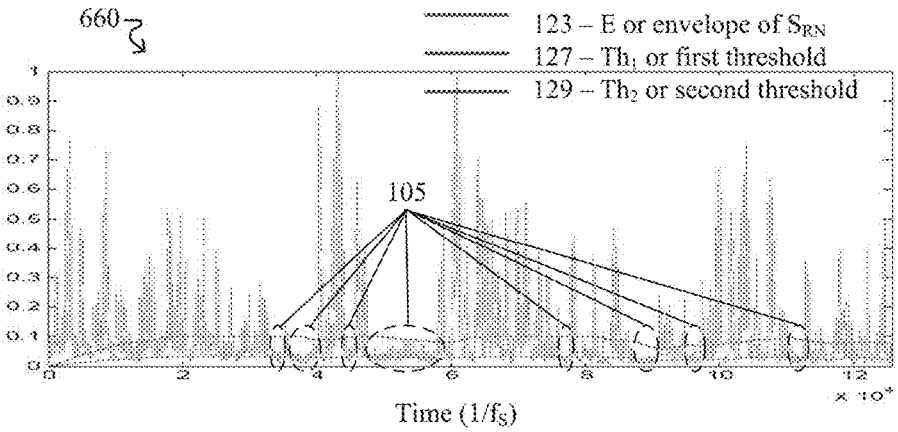
FIGS. 6B-6C show aspects of signals input to, and output from, the gain suppressor of FIG. 6A.

At 610, it is determined whether a sampling time associated with the $k^{th}$ sample of the gain signal G(k) belongs to a portion of the envelope E of the preprocessed audio signal $S_{RN}$ that corresponds to residual noise 105. To make this determination, it is tested whether a value of the $k^{th}$ sample of the first threshold signal $Th_1(k)$ is larger than a value of the $k^{th}$ sample of the envelope E(k), i.e., $E(k)<Th_1(k)$. FIG. 6B is a graph 660 that shows an overlay of the envelope E (also labeled 123) of the preprocessed audio signal $S_{RN}$, the first threshold signal $Th_1$ (also labeled 127), and the second threshold signal $Th_2$ (also labeled 129). When the test performed at 610 is applied to the signals shown in graph 660, it can be determined that the envelope E of the preprocessed audio signal $S_{RN}$ includes multiple portions corresponding to residual noise 105. In graph 660, these portions of residual noise 105 are associated with sampling times for which values of the envelope E sink below the first threshold signal $Th_1$. In contrast, portions of the envelope E of the preprocessed audio signal $S_{RN}$ that correspond to speech 103 are associated with sampling times for which values of the envelope E rise above the first threshold signal $Th_1$.

Figure 6C:
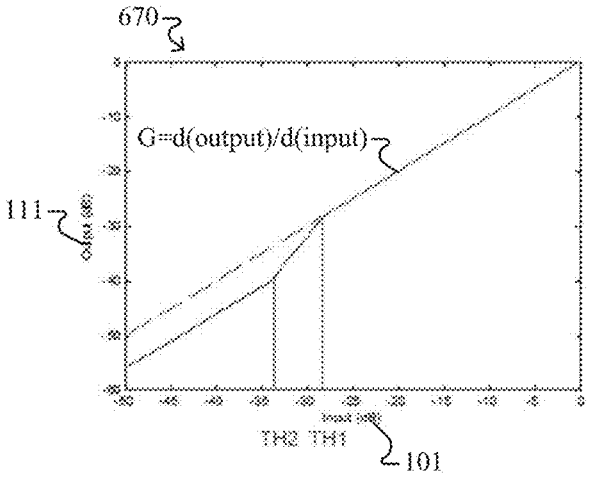

Referring again to FIG. 6A, if a result of the test performed at 610 is false, it is determined that the sampling time associated with the gain sample G(k) does not belong to a portion of the envelope E of the preprocessed audio signal $S_{RN}$ that corresponds to residual noise 105. As such, at 620, a value of the $k^{th}$ sample of the gain signal G(k) can be set to a maximum gain value $G_{MAX}$, for instance. In the example illustrated in FIG. 6A, $G_{MAX}=1$. In this manner, portions of the preprocessed audio signal 101 different from the portions of residual noise 105 (e.g., the portions of speech 103 of the preprocessed audio signal) will not be suppressed. At this point, a next iteration of the loop 605 is triggered to determine a value of the next sample of the gain signal Q(k+1), and so on. FIG. 6C is a graph 670 that shows the processed audio signal 111, output by the amplifier 110, as a function of the preprocessed audio signal 101, input to the amplifier. Here, the gain signal G, generated by the gain suppressor 228 using the process 628, represents the slope of the processed audio signal 111 as a function of the preprocessed audio signal 101. For values of the preprocessed audio signal 101 larger than the first threshold signal $Th_1$, the gain signal G is set to 1.

Referring again to FIG. 6A, if a result of the test performed at 610 is true, then, at 630, it is determined whether a value of the $k^{th}$ sample of the second threshold signal $Th_2(k)$ is smaller than a value of the $k^{th}$ sample of the envelope E(k), i.e., $E(k)\geq Th_2(k)$. If a result of the determination performed at 630 is true, then, at 640, a value of the $k^{th}$ sample of the gain signal G(k) is set to a ratio of a value of the $k^{th}$ sample of the envelope E(k) to a value of the $k^{th}$ sample of the first threshold signal $Th_1(k)$, in the following manner:

$$G(k) = \frac{E(k)}{Th_1(k)}. \quad (9)$$

Because it has been determined at 610 that $E(k)<Th_1(k)$ is satisfied, Eq. No. (9) ensures that a value of the $k^{th}$ sample of the gain signal G(k) is less than 1. In this manner, portions of the preprocessed audio signal 101 that do correspond to residual noise will be suppressed. At this point, a next iteration of the loop 605 is triggered to determine the next sample of the gain signal G(k+1), and so on.

The first threshold signal $Th_1$ represents a tuning parameter of the gain suppressor 125, as suggested in FIGS. 6B-6C. For instance, for larger values of the first threshold signal $Th_1$, there would be more undesired suppression of the gain signal G and, thus, more distortion of portions of speech 103 of the preprocessed audio signal 101; however, there would be more suppression of portions of residual noise 105 of the preprocessed audio signal. Conversely, for smaller values of the first threshold signal $Th_1$, there would be less undesired suppression of the gain signal G and, thus, less distortion of portions of speech 103 of the preprocessed audio signal 101; however, there would be less suppression of portions of residual noise 105 of the preprocessed audio signal. In some implementations, the tuning of the first threshold signal $Th_1$ is carried out at design time, before fabrication of the gain controller 120. In some implementations, the tuning of the first threshold signal $Th_1$ is carried out at fabrication time, before shipping the gain controller 120 (e.g., either by itself or as part of the residual noise suppressor 100). In some implementations, the tuning of the first threshold signal $Th_1$ is carried out at run time (i.e., in the field), either by a user through a user interface of the gain controller 120, or by another process that interacts with the gain controller through an application programming interface (API).

Referring again to FIG. 6A, if a result of the determination performed at 630 is false, then, at 650, a value of the $k^{th}$ sample of the gain signal G(k) is set to a ratio of a value of the $k^{th}$ sample of the second threshold signal $Th_2(k)$ to a value of the $k^{th}$ sample of the first threshold signal $Th_1(k)$, in the following manner:

$$G(k) = \frac{Th_2(k)}{Th_1(k)}. \tag{10}$$

As the second threshold signal $Th_2$ is determined, in accordance with Eq. No. (8), to be a biased value of the first threshold signal Th1, where the bias factor is the threshold ratio R, the $k^{th}$ sample of the gain signal G(k) can be expressed as:

$$G(k)=R \tag{10'}$$

for values of the portions of residual noise 105 of the preprocessed audio signal 101 that are smaller than the second threshold signal $Th_2$. Sampling times corresponding to the foregoing condition can be identified in FIG. 6B inside the ellipses that represent the portions of residual noise 105 of the preprocessed audio signal 101. Moreover, as explained above in connection with Eq. No. (8), the threshold ratio R has a value that is smaller than 1, such that these sub-portions of the portions residual noise 105 of the preprocessed audio signal 101 also will be suppressed. At this point, a next iteration of the loop 605 is triggered to determine the next sample of the gain signal G(k+1), and so on.

Referring again to graph 670 FIG. 6C, for values of the envelope 123 of the preprocessed audio signal 101 that are smaller than the first threshold signal $Th_1$, which correspond to the portions of residual noise 105 of the preprocessed audio signal 101, the gain signal G is smaller than 1. In this manner, the portions of residual noise 105 of the preprocessed audio signal 101 will be suppressed by the amplifier 110. Moreover, for values of the envelope 123 of the preprocessed audio signal 101 that are smaller even than the second threshold signal $Th_2$, which correspond to low-amplitude signal sub-portions of the portions of residual noise 105 of the preprocessed audio signal 101, the gain signal G has a maximum value equal to the threshold ratio R (which is smaller than 1, R<1, as explained above in connection with Eq. No. (10').) As such, this value of the gain signal G causes the amplifier 110 to impart the smallest suppression to the portions of residual noise 105 of the preprocessed audio signal 101. Additionally, for values of the envelope 123 of the preprocessed audio signal 101 that are between the first threshold signal $Th_1$ and the second threshold signal $Th_2$, which correspond to high-amplitude signal sub-portions of the portions of residual noise 105 of the preprocessed audio signal 101, the gain signal G has small values between 0 and the threshold ratio R. Such small values of the gain signal G cause the amplifier 110 to impart large suppression to the portions of residual noise 105 of the preprocessed audio signal 101.

Figure 7:
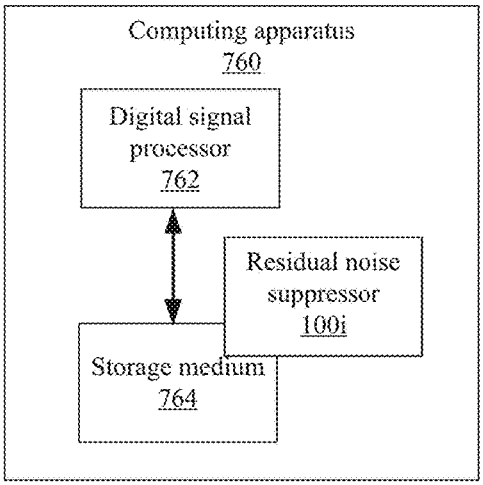
FIG. 7 shows an example of an implementation of a gain controller.

In some implementations, the residual noise suppressor 100 can be implemented in software, as illustrated in FIG. 7. Here, a computing apparatus 760 includes a digital signal processor 762 and storage medium 764 (e.g., memory, hard drive, etc.) encoding residual noise suppressor instructions 100*i* that, when executed by the digital signal processor, cause the computing apparatus to carry out at least some operations performed by the amplifier 110 and the gain controller 120 as part of processes 322, 424, 526 and 628. In some implementations, the computing apparatus 760 is implemented using one or more integrated circuit devices, such as a system-on-chip (SOC) implementation.

Applications are disclosed below, in which the residual noise suppressor 100, described above in connection with FIG. 1A, is used in conjunction with other signal processing systems that determine the preprocessed signal 101.

Figure 8:
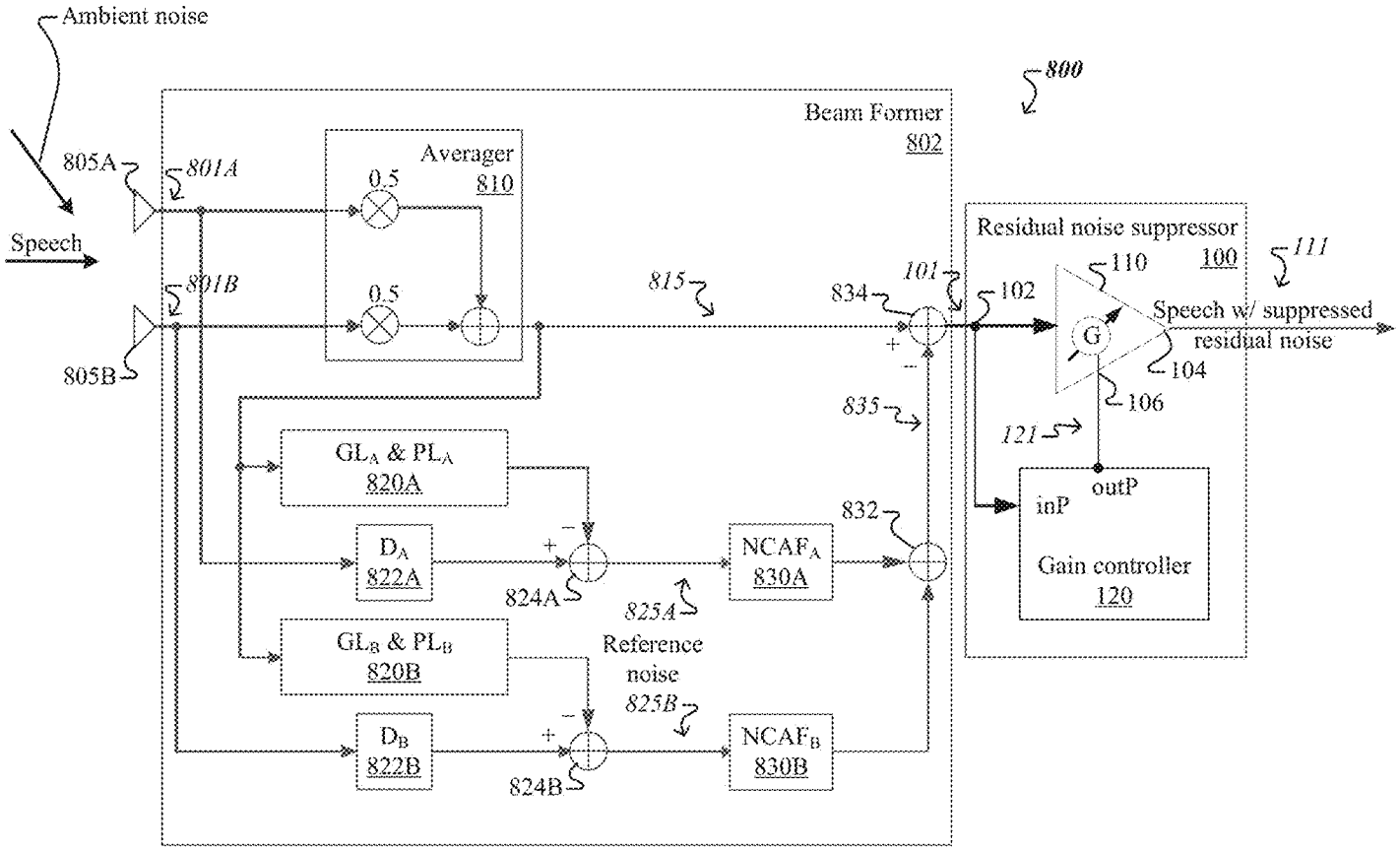
FIG. 8 shows another example of a signal processing system.

FIG. 8 shows an example of a signal processing system 800 that includes a beam former 802 and the residual noise suppressor 100, the latter described above in connection with FIG. 1A. Here, the beam former 802 determines the preprocessed audio signal 101, and the residual noise suppressor 100 further processes the preprocessed audio signal.

The beam former 802 has two input ports 805A and 805B configured to receive (i) speech that arrives at the signal processing system 800 along a speech direction, and (ii) ambient noise along other directions, (in large part) different from the speech direction. Typically, the speech includes utterances separated by silence. As such, respective microphones included in the input ports 805A and 805B convert the received speech and ambient noise to input audio signals 801A and 801B. As such, each of the input audio signals 801A, 801B includes portions of noisy speech (corresponding to a combination of the utterances and ambient noise) separated by portions of ambient noise (corresponding only to the ambient noise that "fills" the silence between the utterances). The beam former 802 is configured to suppress the ambient noise from the input audio signals 801A, 801B, and maintain, undistorted, the portions of speech of the input audio signals. As such, the beam former 802 directionally filters the input audio signals 801A, 801B and outputs a preprocessed audio signal 101. In other words, the beam former 802 outputs a preprocessed audio signal 101 that corresponds to a beam that reaches the input ports 805A, 805B along the speech direction associated with the speech. Moreover, the preprocessed audio signal 101 includes portions of speech and portions of residual noise that separate the portions of speech. The residual noise suppressor 100 (i) receives the preprocessed audio signal 101, and (ii) further suppresses the preprocessed audio signal over portions of residual noise, and maintains, undistorted, the preprocessed audio signal over portions of speech. As such, the residual noise suppressor 100 outputs a processed audio signal 111 from which the residual noise has been suppressed.

In some implementations, the input ports 805A, 805B further include analog to digital converters (ADCs), such that the input audio signals 801A, 801B to be processed by the beam former 802 are digital signals. In such case, a sampling rate of the ADCs can be $f_S$=8 kHz or 16 kHz, for instance, so the speech received by the input ports 805A, 805B can be adequately sampled.

The beam former 802 includes an averager 810 linked to the input ports 805A, 805B; and a subtractor 834 linked to the averager 810. The beam former 802 further includes a subtractor 824A; a gain and phase loop 820A linked to both the averager 810 and the subtractor 824A; and a delay 822A linked to both the input port 805A and the subtractor 824A. Also, the beam former 802 includes an adder 832 linked to the subtractor 834; and a noise cancellation adaptive (NCA) filter 830A linked to both the subtractor 824A and the adder 832. In addition, the beam former 802 includes a subtractor 824B; a gain and phase loop 820B linked to both the averager 810 and the subtractor 824B; a delay 822B linked to both the input port 805B and the subtractor 824B; and a NCA filter 830B linked to both the subtractor 824B and the adder 832. In some embodiments, the beam former 802 is implemented in accordance with the systems and techniques described in U.S. Pat. No. 9,276,618, issued on Mar. 1, 2016, which is hereby incorporated by reference in its entirety.

The components of the residual noise suppressor 100 were described in detail above in connection with FIG. 1A and FIG. 2. In the example illustrated in FIG. 8, the input port 102 of the residual noise suppressor 100 is linked to the subtractor 834 of the beam former 802.

Figure 9:
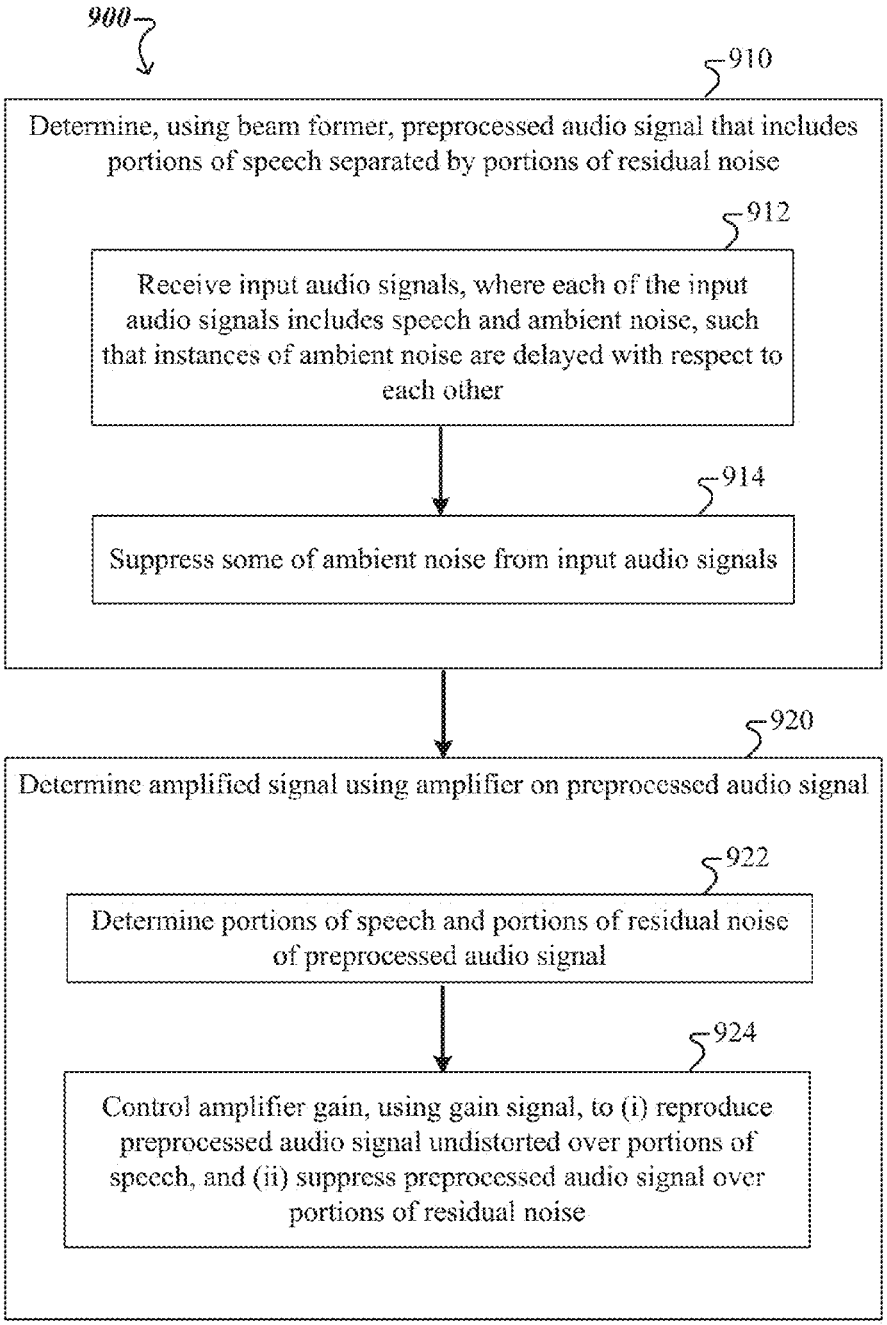
FIG. 9 is a flow chart of a process performed by the signal processing system of FIG. 8.

Functional aspects of the signal processing system 800 are described below as it is implemented to perform process 900 for suppressing ambient noise from audio signals, using multiple suppression stages. FIG. 9 is a flow chart of the process 900.

At 910, the beam former 802 determines the preprocessed audio signal 101 that includes portions of speech 103 separated by portions of residual noise 105. To determine the preprocessed audio signal 101, the beam former 802 performs the following operations.

Figure 10A:
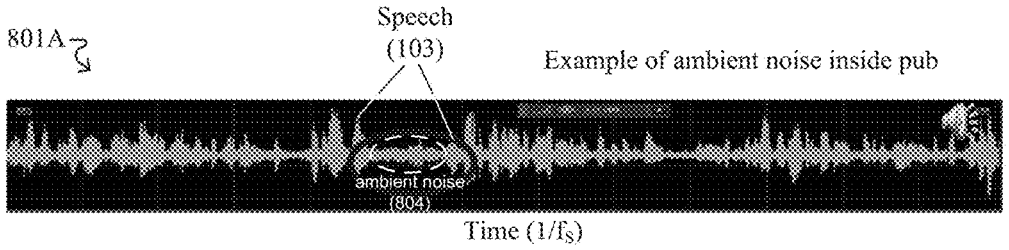
FIGS. 10A-10C, 11A-11C and 12A-12C show aspects of signals input to, and output using, the process of FIG. 9.
Figure 11A:
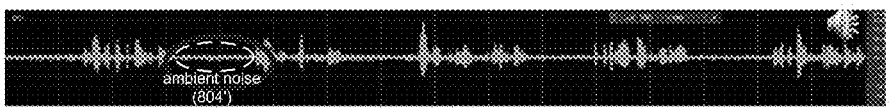
Figure 12A:
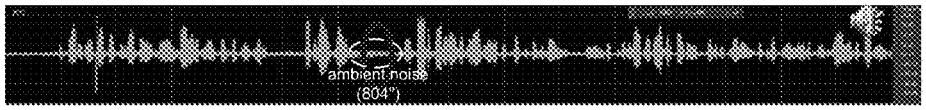

At 912, the beam former 802 receives the input audio signals 805A, 805B, where each of the input audio signals includes speech and ambient noise. Speech arriving at the input ports 805A, 805B of the beam former 802 along a speech direction is received by the input ports substantially at the same time, while the ambient noise arriving at the input ports along directions different from the speech direction is received by the input ports at different times. In this manner, portions of speech of the input audio signals 801A, 801B are in phase with each other, while portions of ambient noise of the input audio signals are out of phase with, or delayed with respect to, each other. FIG. 10A shows an example of the input audio signal 801A that includes portions of speech 103, and portions of ambient noise 804 that originate in a pub, for instance. FIG. 11A shows another example of the input audio signal 801A' that includes portions of speech, and portions of ambient noise 804' that originate inside a car on a road trip, for instance. FIG. 12A shows yet another example of the input audio signal 801A" that includes portions of speech, and portions of ambient noise 804" that originate on a street, for instance.

At 914, the beam former 802 suppresses some of the ambient noise 804 from the input audio signals 801A, 801B, as explained below. Referring to FIG. 8, the averager 810 averages the input audio signals 801A, 801B to obtain an average input audio signal 815. The gain and phase loop 820A adjusts the amplitude and phase of the average input audio signal 815 to obtain a first instance of the adjusted average input audio signal that is a representation of the portions of speech 103 of the input audio signals 801A, 801B; the delay 822A adjusts the delay of the input audio signal 801A to obtain a first adjusted input audio signal, then, the subtractor 824A subtracts the first instance of the adjusted average input audio signal from the first adjusted input audio signal to obtain a first noise-indicating signal 825A (which is a first instance of reference noise) that is a representation of the portions of ambient noise 804 of the input audio signals 801A, 801B. The gain and phase loop 820B adjusts the amplitude and phase of the average input audio signal 815 to obtain a second instance of the adjusted average input audio signal that is another representation of the portions of speech 103 of the input audio signals 801A, 801B; the delay 822B adjusts the delay of the input audio signal 801B to obtain a second adjusted input audio signal; then, the subtractor 824B subtracts the second instance of the adjusted average input audio signal from the second adjusted input audio signal to obtain a second noise-indicating signal 825B (which is a second instance of the reference noise) that is another representation of the portions of ambient noise 804 of the input audio signals 801A, 801B. The NCA filter 830A filters the reference noise 825A to obtain a first instance of filtered reference noise; the NCA filter 830B filters the reference noise 825B to obtain a second instance of filtered reference noise; then, the adder 832 adds the first and second instances of the filtered reference noise to obtain a reconstructed noise signal 835 that is a reconstructed version of the portions of ambient noise 804 of the input audio signals 801A, 801B. The subtractor 834 subtracts the reconstructed noise signal 835 from the average input audio signal 815 to obtain the preprocessed audio signal 101.

Figure 10B:
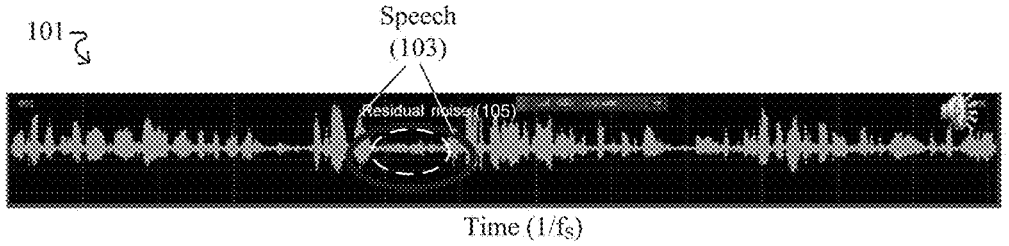
Figure 11B:
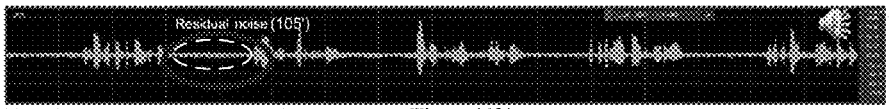
Figure 12B:
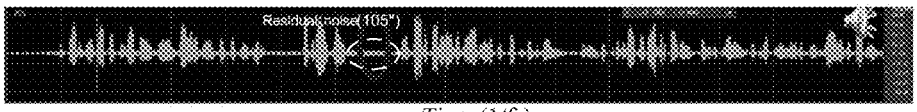

The preprocessed audio signal 101 includes portions of speech (which correspond to the portions of speech of the average input audio signal 815 that have been reproduced without distortion) and portions of residual noise 105 that separate the portions of speech. The portions of residual noise 105 of the preprocessed audio signal 101 correspond to the portions of ambient noise 804 over which the average input audio signal 815 has been suppressed by the beam former 802. FIG. 10B shows an example of the preprocessed audio signal 101 that includes portions of speech 103, and portions of residual noise 105, the latter corresponding to the portions of ambient noise 804 that originate in a pub, shown in FIG. 10A. FIG. 11B shows an example of the preprocessed audio signal 101' that includes portions of speech, and portions of residual noise 105', the latter corresponding to the portions of ambient noise 804' that originate inside a car on a road trip, shown in FIG. 11A. FIG. 12B shows yet another example of the preprocessed audio signal 101" that includes portions of speech, and portions of residual noise 105", the latter corresponding to the portions of ambient noise 804" that originate on a street, shown in FIG. 12A. In each of the foregoing examples, the beam former 802 causes about 3 dB of suppression of the input audio signals 801A, 801A', 801A" over their respective portions of ambient noise 804, 804', 804" to obtain the corresponding portions of residual noise 105, 105', 105" of the preprocessed audio signals 101, 101', 101".

Process 900 continues, at 920, where the residual noise suppressor 100 determines the processed audio signal 111 from the preprocessed audio signal 101. As the residual noise suppressor 100 uses the amplifier 110 to determine the processed signal 111, the latter is also referred to as the amplified signal 111. To determine the processed audio signal 111, the residual noise suppressor 100 performs the following operations.

At 922, the residual noise suppressor 100 determines the portions of speech 103 and portions of residual noise 105 of preprocessed audio signal 101. To perform 922, the residual noise suppressor 100 uses the gain controller 120 described above in connection with FIG. 1A and FIG. 2. The gain controller 120 determines portions of speech 103 and portions of residual noise 105 of preprocessed audio signal 101 using processes 322, 424, 526 and operation 610 of process 628, as described above in connection with FIGS. 3A, 4, 5 and 6A.

At 924, the residual noise suppressor 100 controls the gain of the amplifier 110, based on the gain signal 121, to (i) reproduce the preprocessed audio signal 101 undistorted over the portions of speech 103, and (ii) suppress the preprocessed audio signal over the portions of residual noise 105. The residual noise suppressor 100 generates the gain signal 121, by using the gain controller 120, in accordance with operations 620-650 of process 628, as described above in connection with FIG. 6A.

In addition, the processed audio signal 111 output by the residual noise suppressor 100 includes portions of speech 103 (which correspond to the portions of speech of the preprocessed audio signal 101 that have been reproduced without distortion and suppression), and portions of suppressed residual noise 115 that separate the portions of speech. The portions of suppressed residual noise 115 of the processed audio signal 111 correspond to the portions of ambient noise 804 over which the average input audio signal 815 has been suppressed by the beam former 802 and the preprocessed audio signal 101 has been suppressed by the residual noise suppressor 100.

Figure 10C:
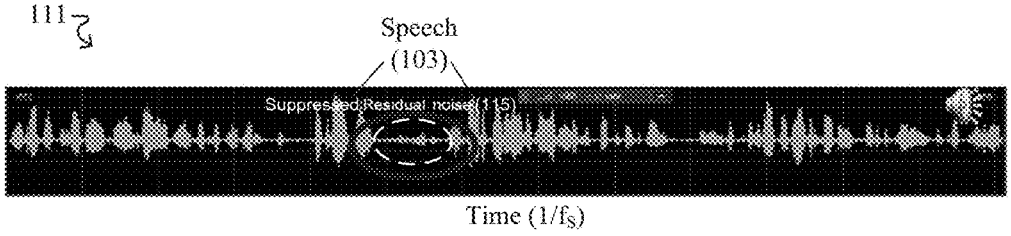
Figure 11C:
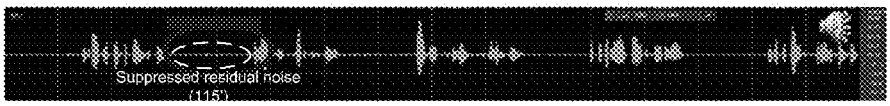
Figure 12C:
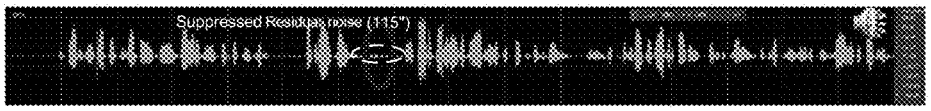

FIG. 10C shows an example of the processed audio signal 111 that includes portions of speech 103, and portions of suppressed residual noise 115, the latter corresponding to the portions of ambient noise 804 that originate in a pub, shown in FIG. 10A. FIG. 11C shows an example of the processed audio signal 111' that includes portions of speech, and portions of suppressed residual noise 115', the latter corresponding to the portions of ambient noise 804' that originate inside a car on a road trip, shown in FIG. 1A. FIG. 12C shows an example of the processed audio signal 111" that includes portions of speech, and portions of suppressed residual noise 115", the latter corresponding to the portions of ambient noise 804" that originate on a street, shown in FIG. 12A. In each of the foregoing examples, the residual noise suppressor 100 causes about 6 dB of additional suppression of the preprocessed audio signals 101, 101', 101" over their respective portions of residual noise 105, 105', 105" to obtain the corresponding portions of suppressed residual noise 115, 115', 115" of the processed audio signals 111, 111', 111".

Figure 13:
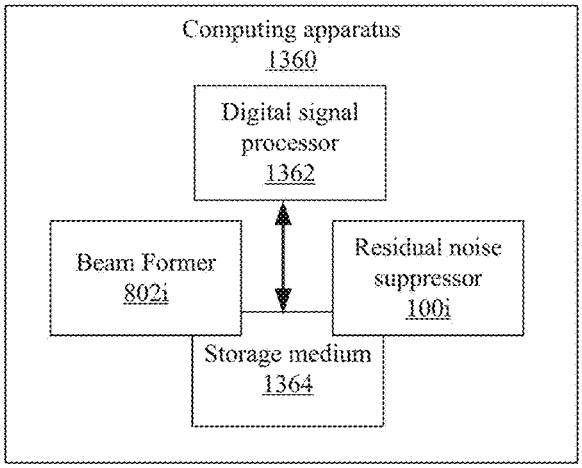
FIG. 13 an example of an implementation of a beam former and a residual noise suppressor of the signal processing system of FIG. 8.

In some implementations, the beam former 802 and the residual noise suppresser 100 of the signal processing system 800 can be implemented in software, as illustrated in FIG. 13. Here, a computing apparatus 1360 includes a digital signal processor 1362 and storage medium 1364 (e.g., memory, hard drive, etc.) encoding beam former instructions 802*i* and residual noise suppressor instructions 100*i* that, when executed by the digital signal processor, cause the computing apparatus to carry out at least some operations performed by the beam former 802 and the residual noise suppresser 140 as part of the process 900. In some implementations, the computing apparatus 1360 is implemented using one or more integrated circuit devices, such as a system-on-chip (SOC) implementation.

A few embodiments have been described in detail above, and various modifications are possible. The disclosed subject matter, including the functional operations described in this specification, can be implemented in electronic circuitry, computer hardware, firmware, software, or in combinations of them, such as the structural means disclosed in this specification and structural equivalents thereof, including system on chip (SoC) implementations, which can include one or more controllers and embedded code.

While this specification contains many specifics, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

Other embodiments fall within the scope of the following claims.

What is claimed is:

1. A method comprising:

determining, by a beam-former, a preprocessed audio signal by removing some noise from an input audio signal, wherein portions of the preprocessed audio signal that include speech are separated by portions of the preprocessed audio signal that include residual noise;

receiving the preprocessed audio signal from the beam-former;

determining a filtered signal using a nonlinear filter on the preprocessed audio signal;

determining a first threshold signal as the filtered signal biased by a bias factor, and a second threshold signal as the first threshold signal biased by a threshold ratio;

determining the portions of the preprocessed audio signal that include residual noise as corresponding to times when an envelope of the preprocessed audio signal is less than or equal to the first threshold signal;

determining the portions of the preprocessed audio signal that include speech as corresponding to times when the envelope of the preprocessed audio signal is larger than the first threshold signal;

setting a gain signal for controlling gain of an amplifier used on the preprocessed audio signal to a value equal to a maximum gain value for the portions of the preprocessed audio signal that include speech, and at least one value smaller than the maximum gain value and larger than or equal to the threshold ratio for the portions of the preprocessed audio signal that include residual noise, wherein values of the gain signal for the portions of the preprocessed audio signal that include residual noise comprise a ratio of the envelope of the preprocessed audio signal to the first threshold signal, when the envelope of the preprocessed audio signal is larger than or equal to the second threshold signal, and a ratio of the second threshold signal to the first threshold signal, when the envelope of the preprocessed audio signal is smaller than the second threshold signal;

determining, by the amplifier the gain of which is controlled by the gain signal, an amplified signal by suppressing the preprocessed audio signal over the portions that include residual noise, and maintaining the preprocessed audio signal over the portions that include speech; and outputting the amplified signal with suppressed residual noise.

2. The method of claim 1, wherein a value of the first threshold signal is in a range from 5% to 20% of a maximum value of the envelope of the preprocessed audio signal.

3. The method of claim 1, wherein a value of the threshold ratio is from 1% to 5% of a maximum value of the maximum gain value.

4. The method of claim 1, wherein the bias factor is in a range from 5% to 20% of a maximum value of the envelope of the preprocessed audio signal.

5. The method of claim 1, wherein the determining of the filtered signal using the nonlinear filter on the preprocessed audio signal comprises using a low pass filter having a cutoff frequency on a magnitude of the preprocessed audio signal, limiting an increase of the filtered signal to a positive value of an envelope limit when the filtered signal increases by more than the positive value of the envelope limit, and limiting a decrease of the filtered signal to a negative value of the envelope limit when the filtered signal decreases by more than the negative value of the envelope limit.

6. The method of claim 1, further comprising:

determining the envelope of the preprocessed audio signal by using a low pass filter having a cutoff frequency on a magnitude of the preprocessed audio signal when the envelope of the preprocessed audio signal increases, and scaling the envelope of the preprocessed audio signal by a release time when the envelope of the preprocessed audio signal decreases.

7. The method of claim 1, wherein the input audio signal includes speech and ambient noise, and the method further comprises obtaining the portions of the preprocessed audio signal that include speech based on removing of some noise from portions of the input audio signal that include both the speech and the ambient noise, and the portions of the preprocessed audio signal that include residual noise based on removing of some noise from portions of the input audio signal that include only the ambient noise.

8. A signal processing system for suppressing residual noise in a preprocessed audio signal which is received from a beam-former, the signal processing system comprising:

an amplifier to determine an amplified signal from the preprocessed audio signal and based on a gain signal, wherein the preprocessed audio signal comprises portions of speech separated by portions of residual noise, and output the amplified signal with suppressed residual noise;

a gain suppressor to determine the portions of residual noise of the preprocessed audio signal as corresponding to times when an envelope of the preprocessed audio signal is at most equal to a first threshold signal;

determine the portions of speech of the preprocessed audio signal as corresponding to times when the envelope of the preprocessed audio signal is larger than the first threshold signal; and set the gain signal to a value equal to a maximum gain value for the portions of speech of the preprocessed audio signal, and at least one value smaller than the maximum gain value and larger than or equal to a threshold ratio for the portions of residual noise of the preprocessed audio signal;

a nonlinear filter to determine a filtered signal from the preprocessed audio signal; and a threshold generator to generate the first threshold signal as the filtered signal weighted by a bias factor, and a second threshold signal as the first threshold signal weighted by the threshold ratio, wherein the at least one value of the gain signal for the portions of residual noise of the preprocessed audio signal comprises a ratio of the envelope of the preprocessed audio signal to the first threshold signal, when the envelope of the preprocessed audio signal is larger than or equal to the second threshold signal, and a ratio of the second threshold signal to the first threshold signal, when the envelope of the preprocessed audio signal is smaller than the second threshold signal.

9. The signal processing system of claim 8, wherein a value of the first threshold signal is in a range from 5% to 20% of a maximum value of the envelope of the preprocessed audio signal.

10. The signal processing system of claim 8, wherein a value of the threshold ratio is in a range from 1% to 5% of a maximum value of the maximum gain value.

11. The signal processing system of claim 8, wherein the bias factor is in a range from 5% to 20% of a maximum value of the envelope of the preprocessed audio signal.

12. The signal processing system of claim 8, wherein, to determine the filtered signal, the nonlinear filter is to low pass filter, based on a first cutoff frequency, a magnitude of the preprocessed audio signal; and limit an increase of the filtered signal to a positive value of an envelope limit, when the filtered signal increases by more than the positive value of the envelope limit, and limit a decrease of the filtered signal to a negative value of the envelope limit, when the filtered signal decreases by more than the negative value of the envelope limit.

13. The signal processing system of claim 12, comprising an envelope generator to low pass filter, based on a cutoff frequency, a magnitude of the preprocessed audio signal when the envelope increases; and scale the envelope by a release time when the envelope decreases.

14. The signal processing system of claim 8, comprising a hardware processor; and storage medium encoded with instructions that, when executed by the hardware processor, cause the signal processing system to use the gain suppressor.

15. The signal processing system of claim 8, wherein the system is a system on chip.

16. The signal processing system of claim 8, further comprising the beam-former to receive an input audio signal, wherein the input audio signal includes speech and ambient noise; and obtain the speech portions of the preprocessed audio signal by removing some noise from portions of the input audio signal that include both the speech and the ambient noise, and obtain the residual noise portions of the preprocessed audio signal by removing some noise from portions of the input audio signal that include only the ambient noise.

* * * * *